US011053954B2

(12) United States Patent
Loerner et al.

(10) Patent No.: US 11,053,954 B2
(45) Date of Patent: Jul. 6, 2021

(54) MODULAR MOTOR PUMP UNIT

(71) Applicant: HAWE HYDRAULIK SE, Aschheim (DE)

(72) Inventors: Gerhard Loerner, Zorneding (DE); Georg Neumair, Thalhausen (DE); Thomas Simon, Freising (DE); Hartmut Verbeek, Munich (DE)

(73) Assignee: HAWE HYDRAULIK SE, Aschheim (DE)

( * ) Notice: Subject to any disclaimer, the term of this patent is extended or adjusted under 35 U.S.C. 154(b) by 81 days.

(21) Appl. No.: 16/553,329

(22) Filed: Aug. 28, 2019

(65) Prior Publication Data

US 2020/0072246 A1 Mar. 5, 2020

(30) Foreign Application Priority Data

Aug. 28, 2018 (DE) ..... 102018214555.5

(51) Int. Cl.
*F04D 29/58* (2006.01)
*F04D 29/40* (2006.01)

(52) U.S. Cl.
CPC ..... *F04D 29/586* (2013.01); *F04D 29/406* (2013.01); *F04D 29/5866* (2013.01)

(58) Field of Classification Search
CPC .. F04D 29/586; F04D 29/5866; F04D 29/406; F04D 29/624; F04D 29/5826; F04D 13/0653; F04D 13/16; F04B 17/03
See application file for complete search history.

(56) References Cited

U.S. PATENT DOCUMENTS 4,775,293 A * 10/1988 Boster ..... F04D 29/5866 277/408
5,616,973 A * 4/1997 Khazanov ..... H02K 5/20 310/54

(Continued)

FOREIGN PATENT DOCUMENTS

CN 102472286 A 5/2012
CN 206309543 U 7/2017

(Continued)

OTHER PUBLICATIONS

German Office Action dated Apr. 5, 2019 (with English Machine Translation), Application No. 10 2018 214 555.5, Applicant HAWE Hydraulik SE, 10 Pages.

(Continued)

*Primary Examiner* — Richard A Edgar
*Assistant Examiner* — Jackson N Gillenwaters
(74) *Attorney, Agent, or Firm* — Brooks Kushman P.C.

(57) ABSTRACT

The present disclosure refers to a modular motor pump unit having an outer housing with two open ends, two housing covers attachable to the open ends, at least one electric motor arranged in the outer housing, at least one pump element arranged in the outer housing and drivable by the electric motor, and at least one connection portion arranged externally on the outer housing. The outer housing forms a hydraulic fluid reservoir, a pressure channel extending from the pump element to the connection portion. A return channel extends from the connection portion to the inside of the outer housing. An additional housing is provided between the outer housing and at least one housing cover. A heat exchanger element is arranged in the additional housing and the return channel is connected to the additional housing and the additional housing is connected to the hydraulic fluid reservoir.

16 Claims, 17 Drawing Sheets

(56) References Cited

U.S. PATENT DOCUMENTS

| | | | | |
|---|---|---|---|---|
| 6,121,698 | A * | 9/2000 | Sexton | F04D 13/06 310/54 |
| 6,524,084 | B2 * | 2/2003 | Neumair | F04B 23/021 417/372 |
| 7,448,858 | B2 * | 11/2008 | Neumair | F04B 23/025 29/888 |
| 9,212,655 | B2 * | 12/2015 | Neumair | F04B 1/08 |
| 10,253,886 | B2 * | 4/2019 | Groette | F04D 29/102 |
| 10,400,801 | B2 * | 9/2019 | Boehler | F04B 53/08 |
| 2018/0335024 | A1 * | 11/2018 | Hughes | F04B 49/08 |

FOREIGN PATENT DOCUMENTS

| | | | |
|---|---|---|---|
| CN | 108141110 | A | 6/2018 |
| DE | 19635424 | A1 | 3/1998 |
| DE | 10 2014 002 410 | A1 | 8/2015 |
| EP | 2 241 753 | B1 | 8/2012 |
| WO | 2005/060370 | A2 | 7/2005 |
| WO | 2011/019334 | A1 | 2/2011 |

OTHER PUBLICATIONS

Chinese Office Action dated Jan. 28, 2021 (with English Machine Translation), Application No. 201910814828.3, Applicant Hawe Hydraulics, 16 Pages.

* cited by examiner

MODULAR MOTOR PUMP UNIT

CROSS-REFERENCE TO RELATED APPLICATIONS

This application claims foreign priority benefits under 35 U.S.C. § 119(a)-(d) to German patent application number DE 10 2018 214 555.5, filed Aug. 28, 2018, which is incorporated by reference in its entirety.

TECHNICAL FIELD

This disclosure relates to a modular motor pump unit. In particular, the disclosure relates to a modular motor pump unit for hydraulic applications.

BACKGROUND

Such modular pump units are known from the state of the art, for example from the HP 2 241 753 B1. These motor pump units regularly have an outer housing with two open ends, whereby the two open ends can be closed via two attachable housing covers. The outer housing with the housing covers thus forms a hydraulic fluid reservoir. An electric motor and at least one pump element driven by the electric motor are arranged in the outer housing. The pump element can, for example, be a radial piston pump element or a gear pump element. It is also conceivable that more than one pump element is arranged in the outer housing. The electric motor regularly has a stator, which is fixed in a stator seal inside the housing.

A connection portion with at least one pressure connection and at least one return hydraulic fluid connection is regularly disposed outside on the outer housing. A pressure channel extends from the pump element to the connection portion and a return channel extends from the connection portion to the inside of the outer housing. The hydraulic fluid under pressure is fed into the hydraulic system connected to the motor pump unit via the pressure channel and the pressure connection. Areas of application for such motor pump units include mobile high-pressure hydraulic systems, hydraulic systems of machine tools, portable or mobile hydraulic devices or hydraulic adjustment devices for solar collectors. In these applications the motor pump units are used upright or horizontal. An upright operation means that the pump element is arranged below the stator.

A common feature of all hydraulic systems is that the hydraulic fluid led back via the return hydraulic fluid connection and the return channel is heated due to the mechanical load in the hydraulic system. Excessively heated hydraulic fluid can lead to problems in the hydraulic system and significantly reduce the service life of seals, for example, it is also essential to prevent the heated hydraulic fluid from being sucked directly back through the pump element and fed into the hydraulic system.

Therefore, active and passive systems for cooling the hydraulic fluid are known from the prior art. As a passive system, the outer housing can be fitted with cooling fins on the outside in order to achieve improved heat dissipation to the environment. In active systems, the returning hydraulic fluid is passed through a heat exchanger before being introduced into the hydraulic fluid reservoir.

A disadvantage of the known active systems is that they are either provided as an external component in the hydraulic system, or have to be provided in a complex manner during the manufacture of the pump unit. A modular design of such a pump unit is then regularly not possible.

SUMMARY

It is therefore an object of the present disclosure to provide a modular motor pump unit in which an optional and flexible cooling of the returning hydraulic fluid is possible.

A modular pump unit according to the disclosure may be characterized over the prior art in that an additional housing is provided between the outer housing and at least one housing cover. A heat exchanger element is arranged in the additional housing and the return channel is connected to the additional housing. The additional housing is connected to the hydraulic fluid reservoir.

In other words, the returning (heated) hydraulic fluid is not fed directly into the hydraulic fluid reservoir, but first is fed through the additional housing. There it is cooled by the heat exchanger element before it is fed from the additional housing into the hydraulic fluid reservoir. The motor pump unit can be flexibly constructed because the additional housing is optionally arranged between one of the two open ends of the outer housing and one of the corresponding housing covers. It is therefore possible to place the additional housing either at one or the other open end, i.e., either at the stator end of the outer housing or at the pump element end of the outer housing. This considerably simplifies the assembly of the modular motor pump unit, as the additional housing can be provided in modular form according to the customer's requirements.

It is advantageous if the heat exchanger element comprises a liquid cooling, in particular water cooling. On the one hand, liquid cooling has the advantage that sufficient cooling of the returning hydraulic fluid can be achieved. On the other hand, the hydraulic systems in which the motor pump unit according to the disclosure is used regularly already have liquid cooling circuits. Therefore, the liquid cooling of the motor pump unit can be easily integrated.

Alternatively, it is preferable if the heat exchanger element comprises an air cooling. In particular, the heat exchanger element may have an external cooling fan for this purpose. Air cooling has the advantage that only one electrical connection is required to operate the external cooling fan. This eliminates the need for additional piping for liquid cooling.

The additional housing preferably has at least one inlet opening and at least one outlet opening, wherein the return channel is connected to the inlet opening, and wherein the outlet opening is connected to the hydraulic reservoir. This allows the returning hydraulic fluid to be directed through the inlet opening into the additional housing where it is cooled and then directed through the outlet opening into the hydraulic reservoir. This effectively prevents the pump element from sucking in directly returning (and therefore heated) hydraulic fluid.

It is advantageous if the additional housing has at least one drain channel connected to the hydraulic fluid reservoir with a safety valve, in particular a pressure limiting valve or a check valve. This ensures that a possible overpressure in the additional housing does not damage the heat exchanger element. In particular, it is advisable to use a preloaded check valve.

The drain channel is provided as a branch channel of the inlet opening. This means that an overpressure building up in the area of the inlet opening can be quickly relieved into the hydraulic fluid reservoir.

It is advantageous if the outer housing has a transverse wall arranged inside the outer housing and a cover, the transverse wall with the cover defining a collection chamber with at least one connection arrangement to the additional housing, the return channel emptying into the collection chamber. By collecting the returning hydraulic fluid in the collection chamber, this can initially be steadied so that no foaming occurs. This results in better cooling of the returning hydraulic fluid, as the cooling efficiency is noticeably lower with foamed hydraulic fluid. This also has an advantageous effect on the entire hydraulic system, as the overall efficiency of the hydraulic system increases and possible wear due to foamed hydraulic fluid is reduced.

The collection chamber preferably has at least two connection openings, one of the connection openings facing toward an open end of the outer housing and the other one of the connection opening facing towards the other open end of the outer housing, and one connection opening being connected to the additional housing via the connection arrangement and the other connection opening being closed via a plug. This means that a standardized motor pump unit can be provided by the manufacturer, regardless of whether the additional housing is on the stator side or on the pump element side. The unused connection opening of the collection chamber is closed with the plug during assembly. This saves costs while at the same time allowing flexible adaptation of the motor pump unit.

Advantageously, the connection arrangement comprises a first connecting tube, the first connecting tube connecting the collection chamber to the additional housing. The return hydraulic fluid collected in the collection chamber can be channeled through the first connecting tube and directed into the additional housing in order to achieve an optimum cooling result.

Preferably, the first connecting tube has a first end disposed in the collection chamber, the first end having a plurality of radial openings. This is particularly useful if the additional housing is arranged on the stator side in order to achieve a homogeneous volume flow from the collection chamber to the additional housing.

It is preferable if the transverse wall has a plurality of axial through-holes. The already cooled return hydraulic fluid can flow between the stator end of the outer housing and the pump element end of the outer housing through these through-holes.

It is advantageous if the additional housing is connected to one of the axial through-holes via a second connecting tube. In particular, it is advantageous if the second connecting tube has a second end, wherein the second end has a plurality of radial openings, and wherein either the second end in the axial direction or the through opening is closed with a plug.

When arranging the additional housing on the stator side, it is advisable to use both connecting tubes with radial openings when the motor pump unit is operated in an upright position, in order to prevent foaming of the returning (and already cooled) hydraulic fluid by mechanical impact when it exits the outlet opening of the additional housing. The hydraulic fluid then flows through the axial openings to the pump element, or exits under the fluid level in the hydraulic fluid reservoir. In the case of a horizontal position and arrangement of the additional housing on the stator side, the second connecting lube can be dispensed as the returning (and already cooled) hydraulic fluid exits the outlet opening below the fluid level in the hydraulic fluid reservoir.

When arranging the additional housing on the pump element side, it is advisable to use two connecting tubes without radial openings in order to achieve a selective channeling of the returning hydraulic fluid from the collection chamber to the additional housing. Since the cooled hydraulic fluid exits below the fluid level in the hydraulic fluid reservoir during horizontal operation of the motor pump unit, mechanical loading—and consequently foaming—does not occur. When the motor pump unit is not in use, the returning (and already cooled) hydraulic fluid exits above the transverse wall in the stator-side area of the outer housing and runs through the axial through-opening to the pump element. Since the hydraulic fluid exits under atmospheric pressure against gravity, foaming is unproblematic here.

It is preferable for the additional housing to have at least one additional opening extending outwards from the inside of the additional housing for the connection of an external hydraulic fluid line. Through this additional opening, for example, leakage fluid occurring in the hydraulic system can be fed directly into the additional housing for cooling.

If is advantageous if the additional housing has at least two openings for mounting the heat exchanger element. If the heat exchanger element has a liquid cooling, it is advantageous if the openings can be closed using cover plates. It is advisable if one of the two cover plates has corresponding connections for the cooling medium, so that an optional arrangement of these connections on the additional housing is possible. This remarkably increases flexibility. If the heat exchanger element has air cooling, it is advantageous if an external fan is arranged at one of the openings, which directs the cooling air into the inside of the additional housing. The forced cooling fan can optionally be mounted on the additional housing, thus increasing the overall flexibility.

In the following, embodiments according to the disclosure are explained in more detail using the examples shown in the figures.

DETAILED DESCRIPTION

Figure 1:
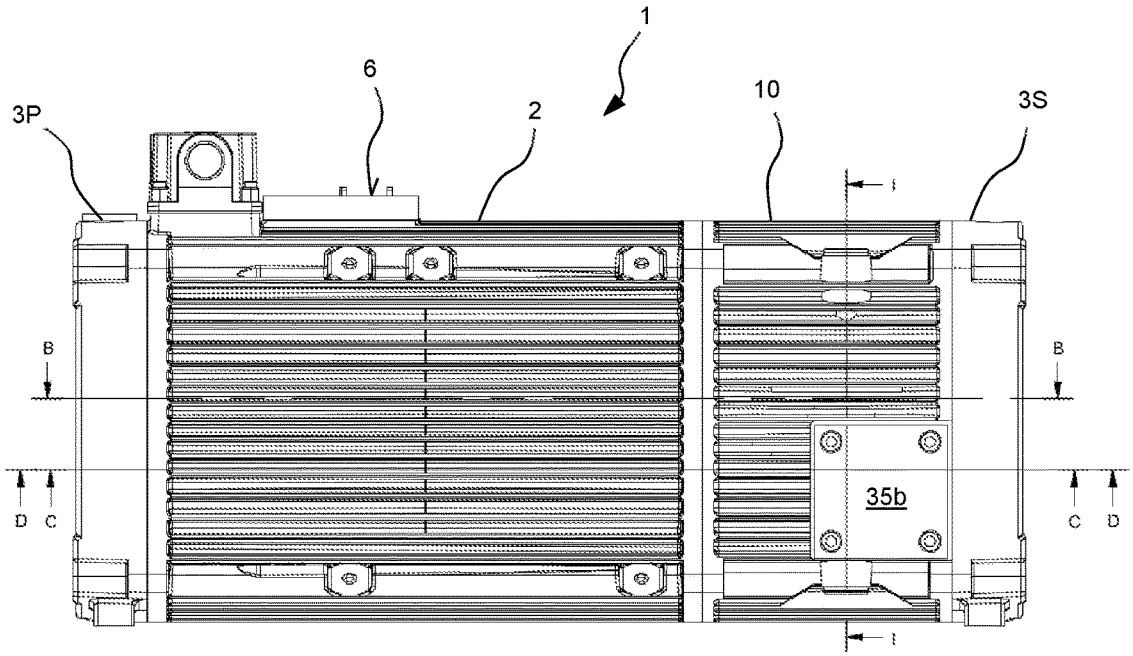
FIG. 1 is a side view of a motor pump unit according to the disclosure according to a first embodiment with an additional housing on the stator side.
Figure 2:
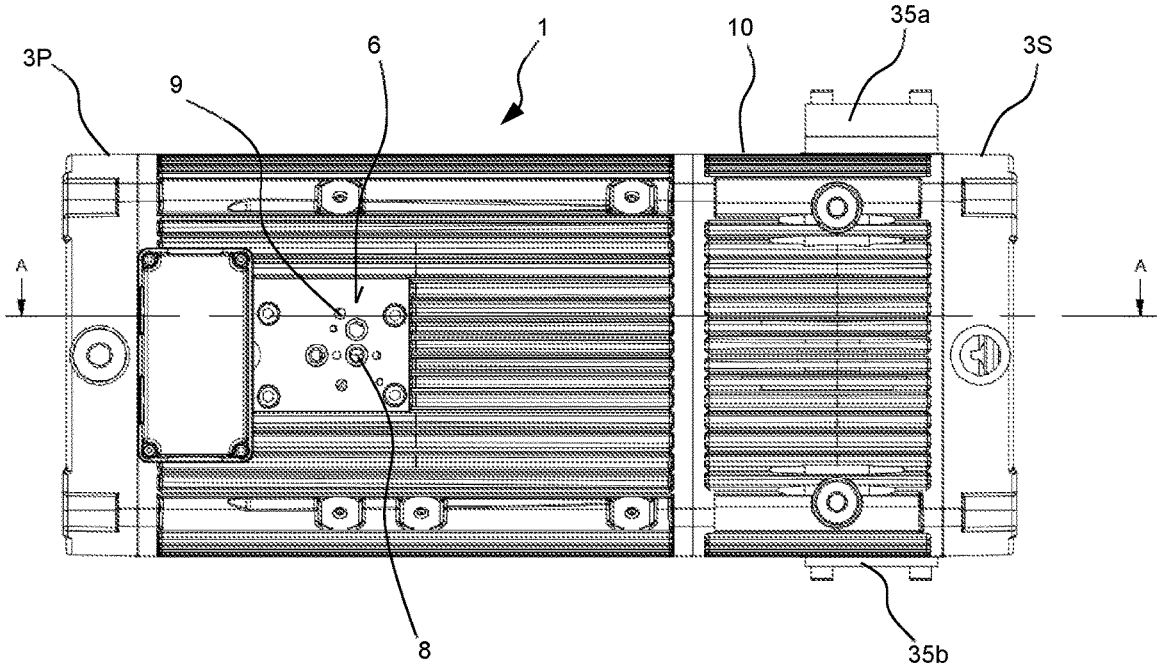
FIG. 2 is a top view of the motor pump unit shown in FIG. 1.
Figure 3:
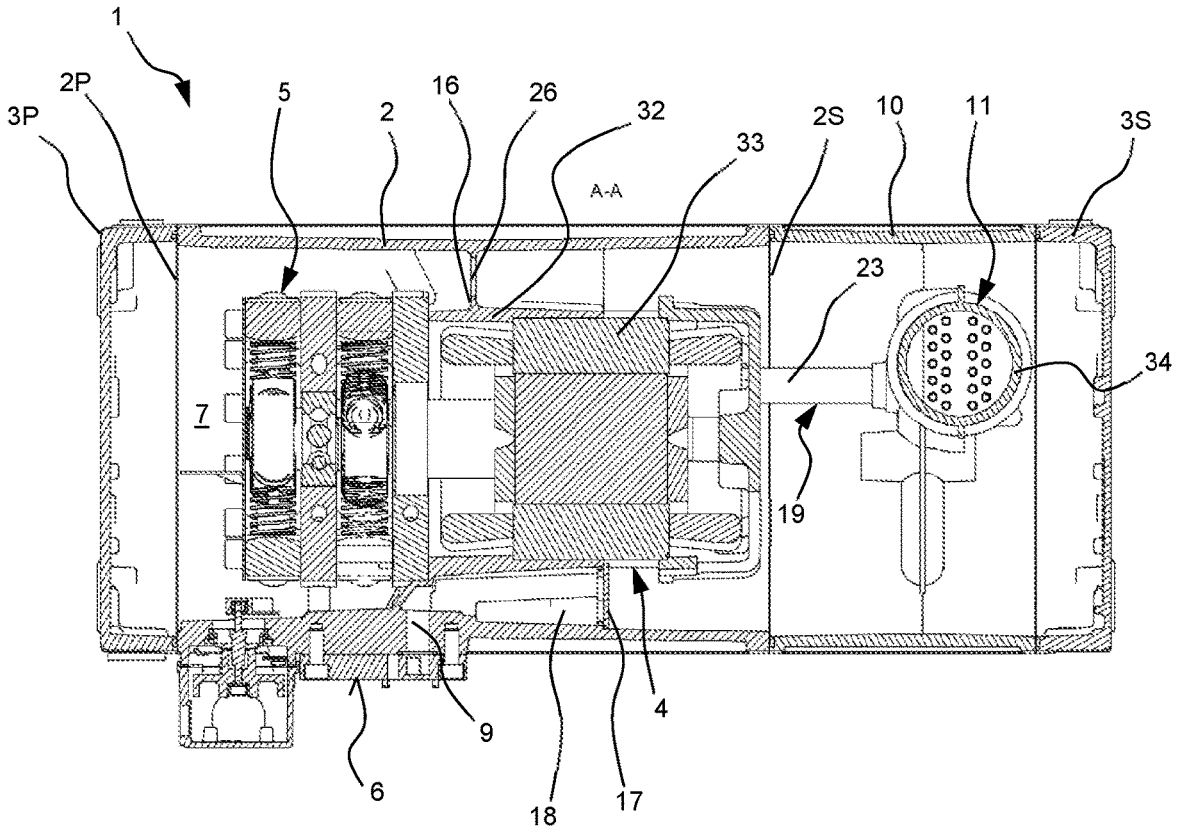
FIG. 3 is a cross section along the line A-A shown in FIG. 2.
Figure 4:
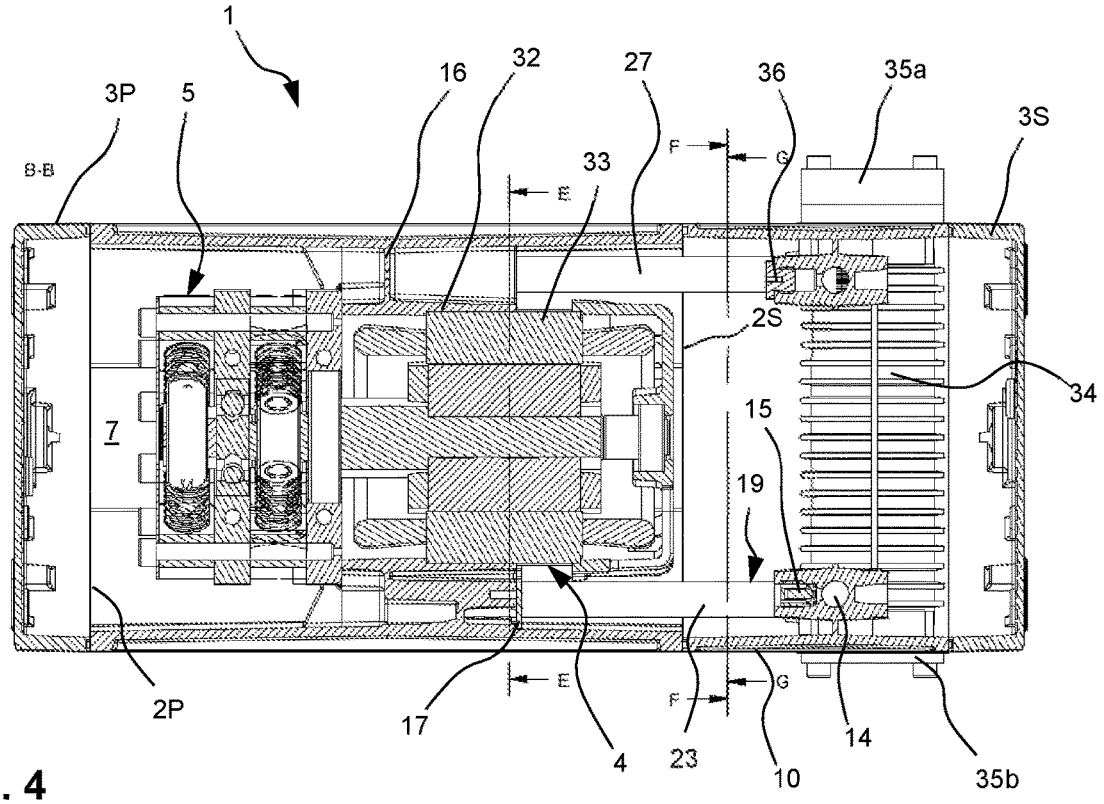
FIG. 4 is a cross section along the line B-B shown in FIG. 1.

FIGS. 1 to 11 show a modular motor pump unit 1 according to a First embodiment and FIGS. 13 to 22 show a modular motor pump unit 100 according to a second embodiment. In the following, first the modular motor pump unit 1 is described in detail according to the first embodiment.

The motor pump unit 1 according to the First embodiment has an outer housing 2 with a connection portion 6 on the outer circumference. The connection portion 6 has a pressure connection and a return hydraulic fluid connection. The outer housing 2, for example, is a gravity die casted part made of light metal, such as aluminum or aluminum alloy. A transverse wall 16 with a plurality of axial through-holes 26 is arranged in the outer housing 2, which has a stator plug seat 32 to accommodate the stator 33 of an electric motor 4. The electric motor 4 drives a pump element 5 fixed in the outer housing 2 in a conventional way in such a way that hydraulic fluid is pumped from a hydraulic fluid reservoir 7 formed in the inside of the motor pump unit via a pressure channel 8 to the pressure connection of the connection portion 6. In this example the pump element 5 is a radial piston pump element.

In addition, a return channel 9 extends from the return hydraulic fluid connection of the connection portion 6 to the inside of the outer housing 2. The heated hydraulic fluid of the hydraulic system supplied by the motor pump unit 1 flows back to the hydraulic fluid reservoir 7 via the return channel 9, as described in more detail below.

The outer housing 2 further comprises two open ends 2S, 2P, namely a stator-side open end 2S and a pump element-side open end 2P. In the embodiment shown, the pump element-side open end 2P is scaled with a pump element-side housing cover 3P. At the stator-side open end 2S an additional housing 10 is arranged between a stator-side housing cover 3S and the outer housing 2. Both the housing covers 3P, 3S and the additional housing 10 can, for example, be supplied as gravity die casted parts made of light metal such as aluminum or aluminum alloy. The additional housing 10 can also be provided as a die casted part or plastic part.

A heat exchanger element 11 in the form of liquid cooling is arranged in the additional housing 10. As shown in particular in FIGS. 4 to 6, the heat exchanger element 11 is arranged in a ribbed casing 34 of the additional housing 10. Of course, the casing 34 can also be designed without ribs, in order to mount the heat exchanger element 11, the additional housing 10 has openings on both sides (see also FIGS. 23 and 24), which are closed with corresponding cover plates 35*a*, 35*b* after mounting, in particular screwed. The heat exchanger element 11 can thus be mounted in such a way that the connection side for the coolant circuit can be freely selected. For this purpose one of the two cover plates 35*a* has corresponding connections for the coolant circuit, as can be seen for example in FIG. 11. Furthermore, the additional housing 10 has an inlet opening 12 and an outlet opening 13.

The return channel 9 is connected to the inlet opening 12 via a connection arrangement 19, so that the returning (and heated) hydraulic fluid is not fed directly into the hydraulic reservoir 7. Rather, the returning hydraulic fluid is First led over the heat exchanger element 11 and thereby cooled down. The now cooled hydraulic fluid is then fed into the hydraulic fluid reservoir 7 via the outlet opening 13 so that it can be sucked in again by the pump element 5.

Figure 5:
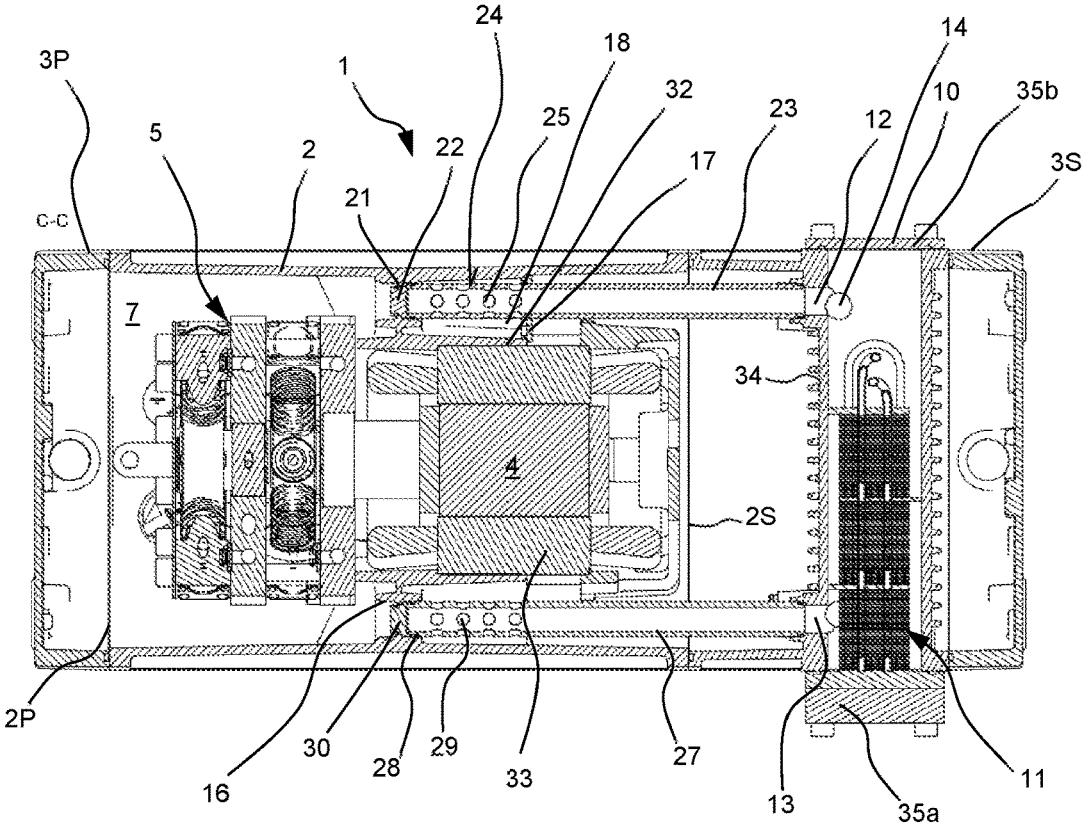
FIG. 5 is a cross section along the line C-C shown in FIG. 1 for a variant with a motor pump unit arranged upright.
Figure 6:
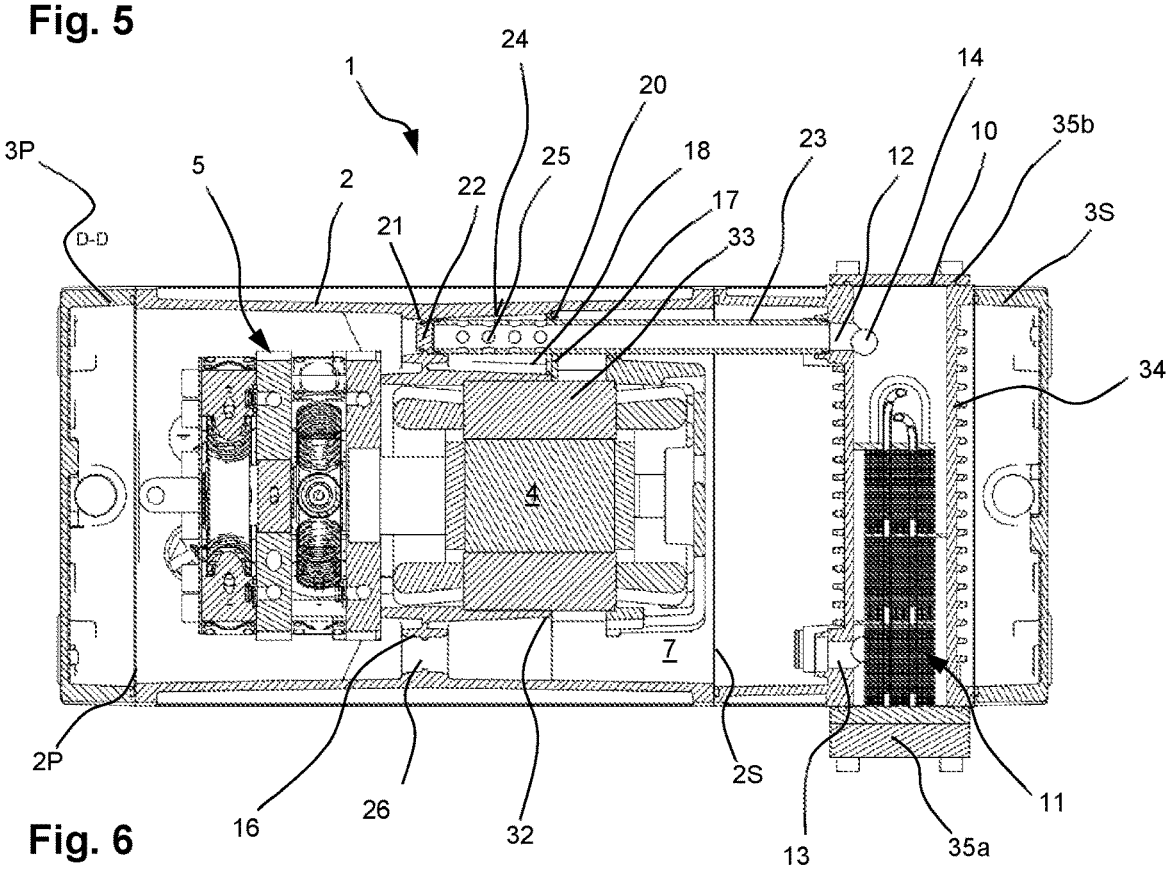
FIG. 6 is a cross section along the line D-D shown in FIG. 1 for a variant with a motor pump unit arranged horizontally.
Figure 7:
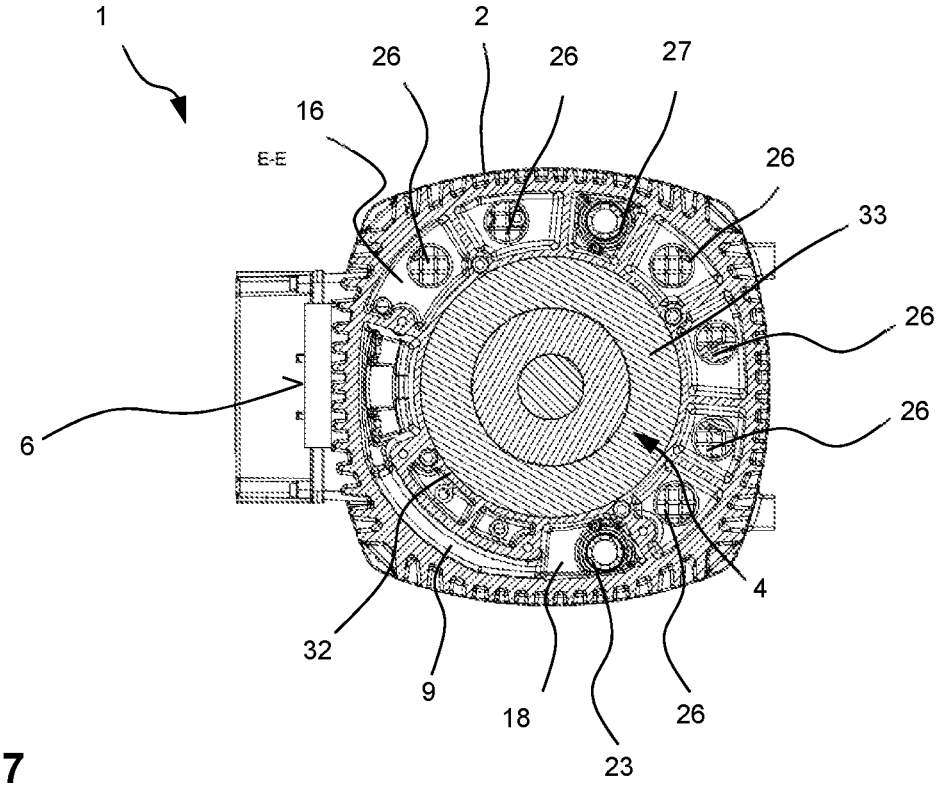
FIG. 7 is a cross section along the line E-E shown in FIG. 4.
Figure 8:
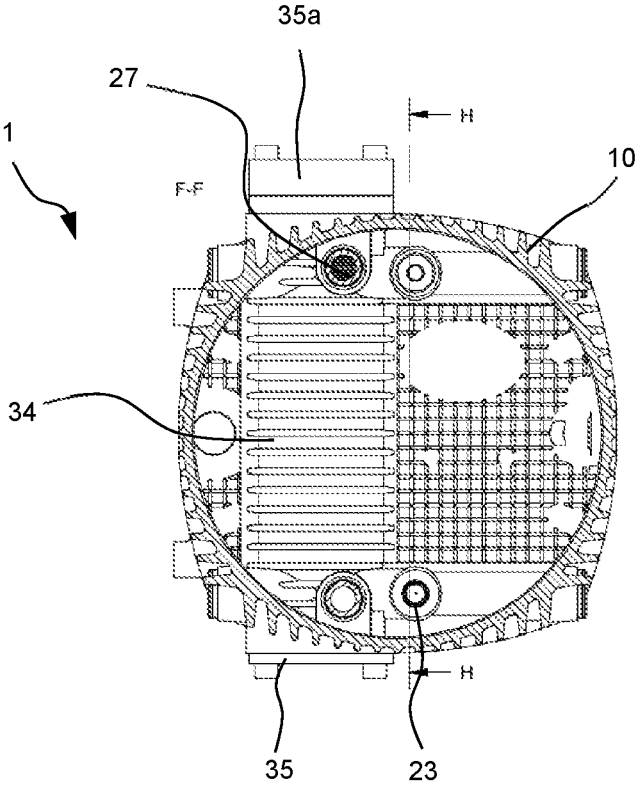
FIG. 8 is a cross section along the line F-F shown in FIG. 4.
Figure 9:
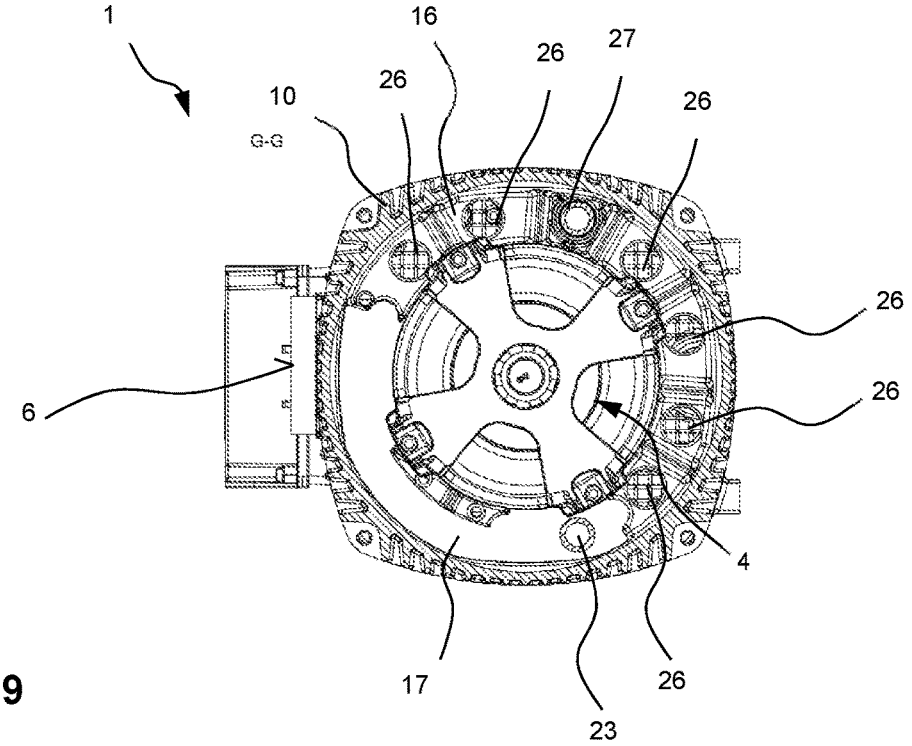
FIG. 9 is a cross section along the line G-G shown in FIG. 4.

For this purpose, the pump unit has a collection chamber 18, which is formed between the transverse wall 16 and a cover 17. The return channel 9 empties into this collection chamber 18 in order to steady the returning hydraulic fluid and to prevent foaming. The collection chamber 18 has two connection openings 20, 21. A first connection opening 20 points in the direction of the stator-side open end 2S and is formed in the cover 17. The second connection opening 21 is formed in the transverse wall 16 and lies axially opposite the first connection opening 20 and points in the direction of the pump element-side open end 2P, as can be seen in particular in FIGS. 5 and 6. It should be noted here that FIG. 5 shows a variant of the motor pump unit 1 according to the first embodiment for upright operation, in which the motor pump unit 1 is arranged with the pump element 5 pointing downwards. FIG. 6 shows a variant for horizontal operation of the motor pump unit 1.

As shown, a first connecting tube 23 of connection arrangement 19 extends through the first connection opening 20 into collection chamber 18. The second connection opening 21 is closed by a plug 22. The first connecting tube 23 is connected to the inlet opening 12 of the additional housing, so that hydraulic fluid from the collection chamber 18 is forced to pass through the first connecting tube 23 and the inlet opening 12 to the heat exchanger element 11.

Figure 12:
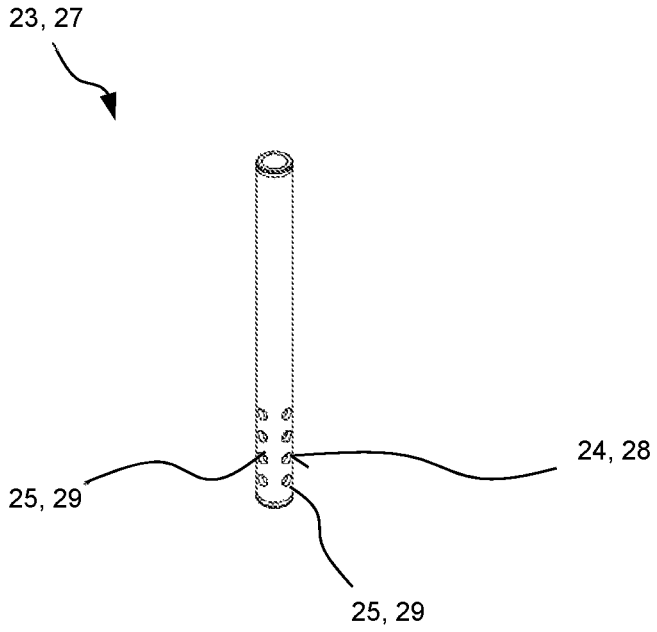
FIG. 12 is a perspective view of a connecting tube.
Figure 13:
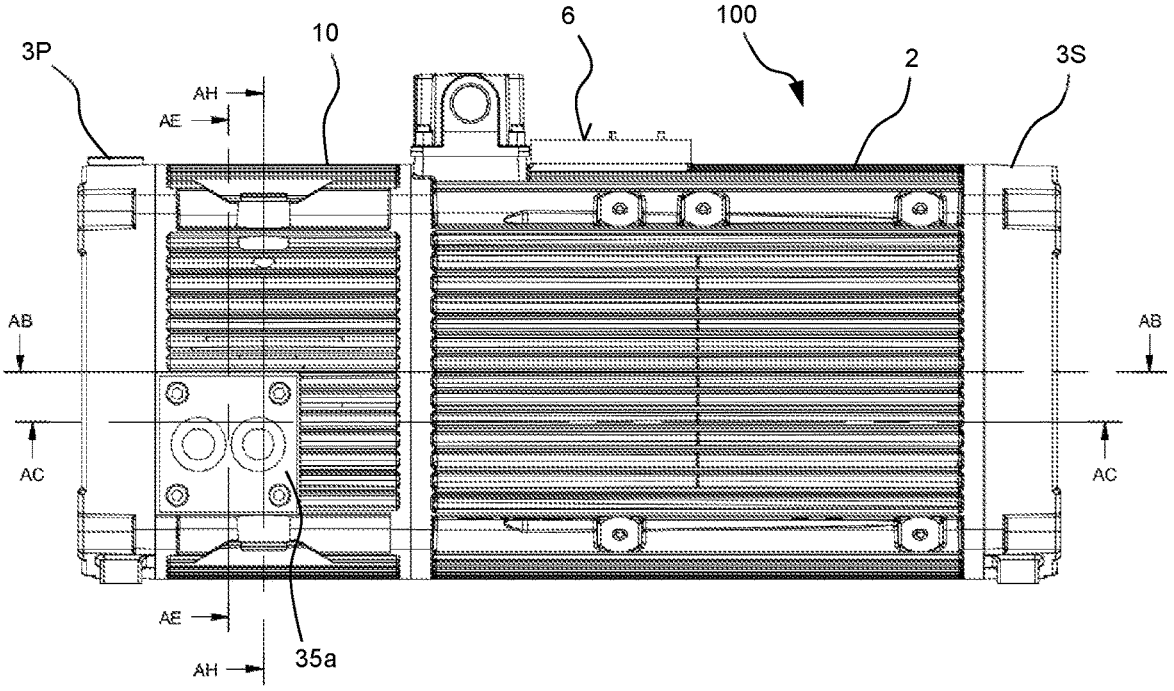
FIG. 13 is a side view of a motor pump unit according to the disclosure according to a second embodiment with the additional housing arranged on the pump element side.
Figure 14:
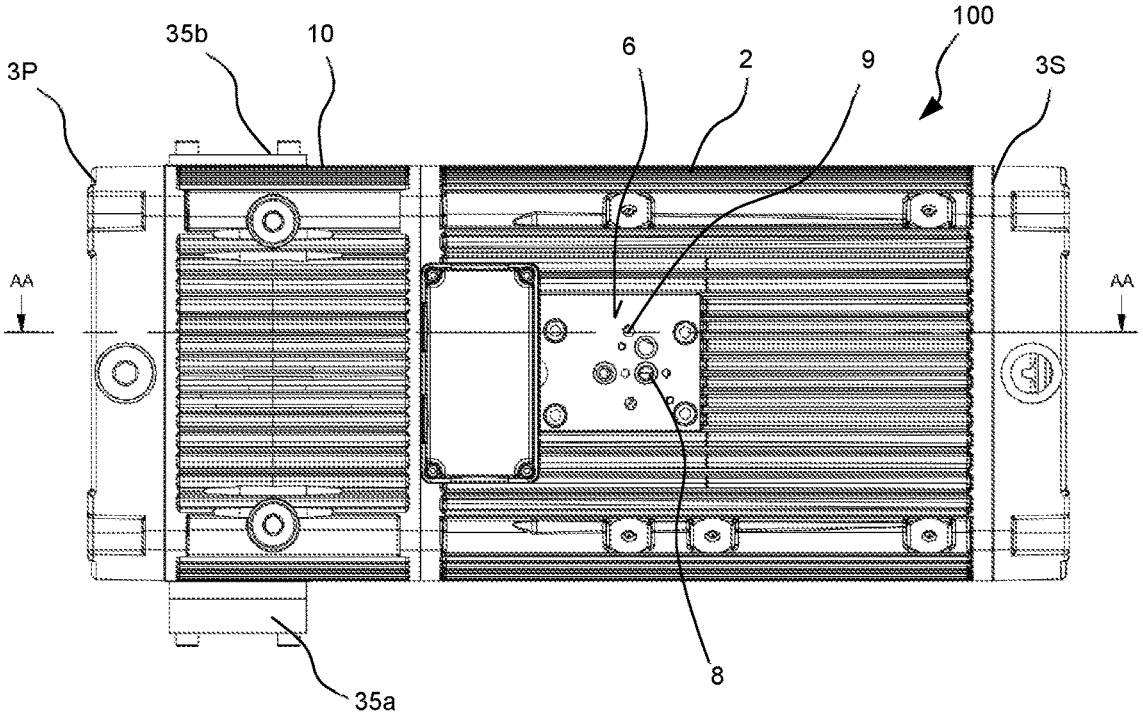
FIG. 14 is a top view of the motor pump unit shown in FIG. 13.
Figure 15:
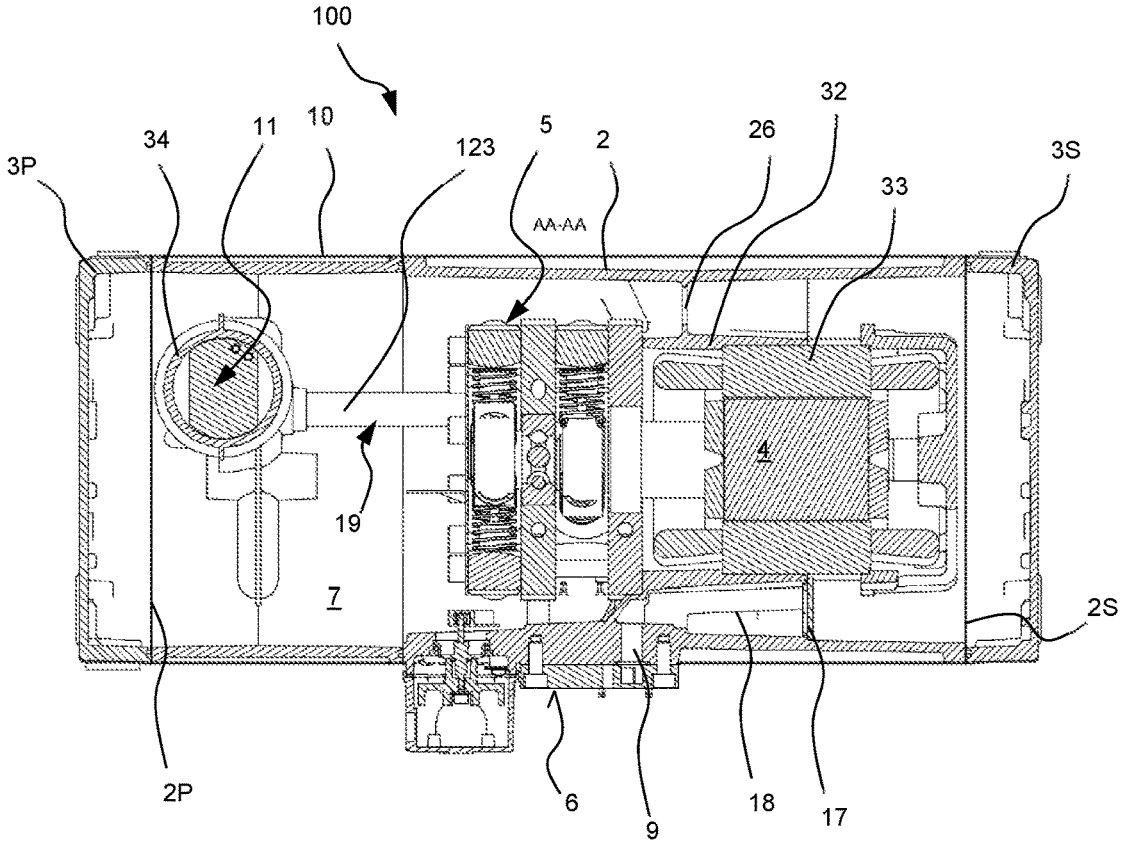
FIG. 15 is a cross section along the line AA-AA shown in FIG. 14.
Figure 16:
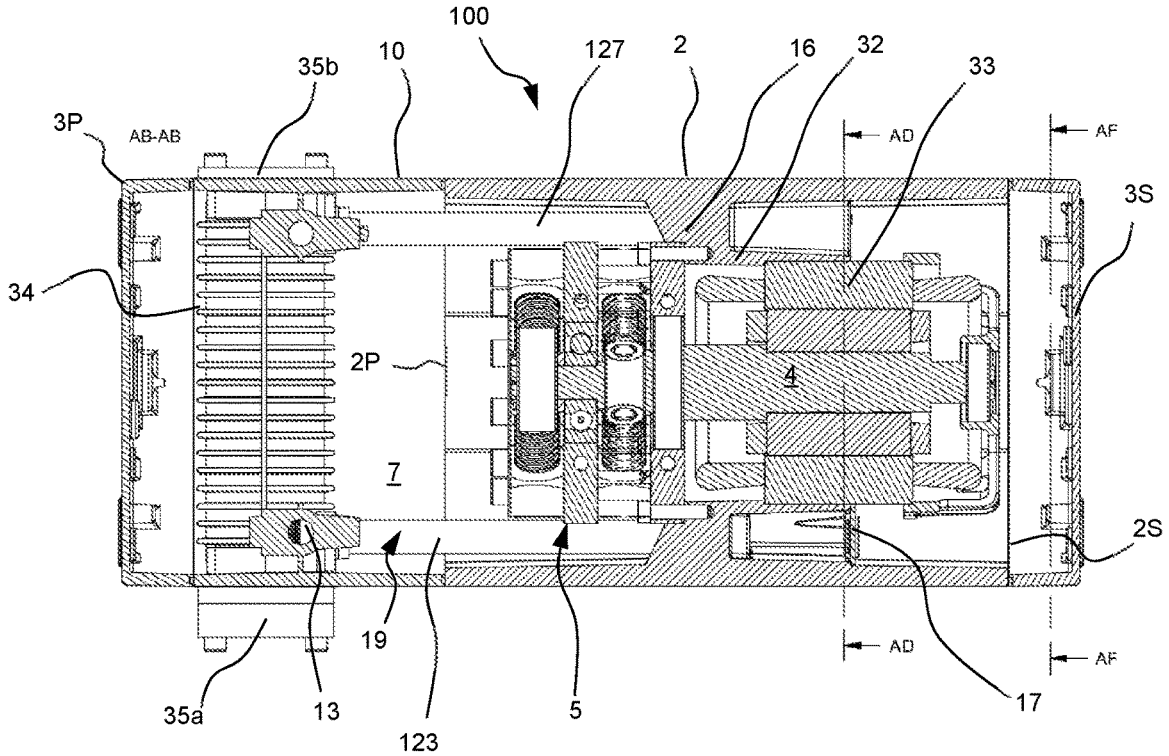
FIG. 16 is a cross section along the line AB-AB shown in FIG. 13.

The first connecting tube 23 has a first end 24 with a plurality of radial openings 25. The hydraulic fluid enters through these openings 25 into the interior of the connecting tube 23, see also FIG. 12.

Furthermore the motor pump unit 1 of the variant for horizontal operation shown in FIG. 5 has a second connecting tube 27, which is constructed identically to the first connecting tube 23. The second connecting tube 27 has a second end 28, which also has a plurality of radial openings 29, see also FIG. 12. The second connecting tube 27 connects the outlet opening 13 of the additional housing 10 with an axial through-hole 26 of the transverse wall 16. As shown in FIG. 5, this through-hole 26 is closed with a plug 30. This arrangement prevents the cooled hydraulic fluid from leaking out of the outlet opening 13 of the additional housing 10 and above the fluid level in the hydraulic fluid reservoir 7. The latter would lead to mechanical loading of the hydraulic fluid and thus to undesired foaming. Due to the second connecting tube 27, the cooled hydraulic fluid exits below the fluid level in the hydraulic fluid reservoir 7 via the radial openings 29 and is distributed along the transverse wall 16. For this purpose, the transverse wall 16 may have individual chambers, each enclosing a through-hole 26 and open towards the stator-side open end 2S. This arrangement results in a good overall mixing of the hydraulic fluid in the hydraulic fluid reservoir 7.

The variant shown in FIG. 6 for horizontal use of the motor pump unit 1 differs from the variant shown in FIG. 5 in that no second connecting tube and no plug are provided for closing the axial through-hole 26. Here the cooled hydraulic fluid exits via the outlet opening 13 of the additional housing 10 directly below the fluid level in the hydraulic fluid reservoir 7, so that there is no mechanical load and thus no foaming.

Figure 10:
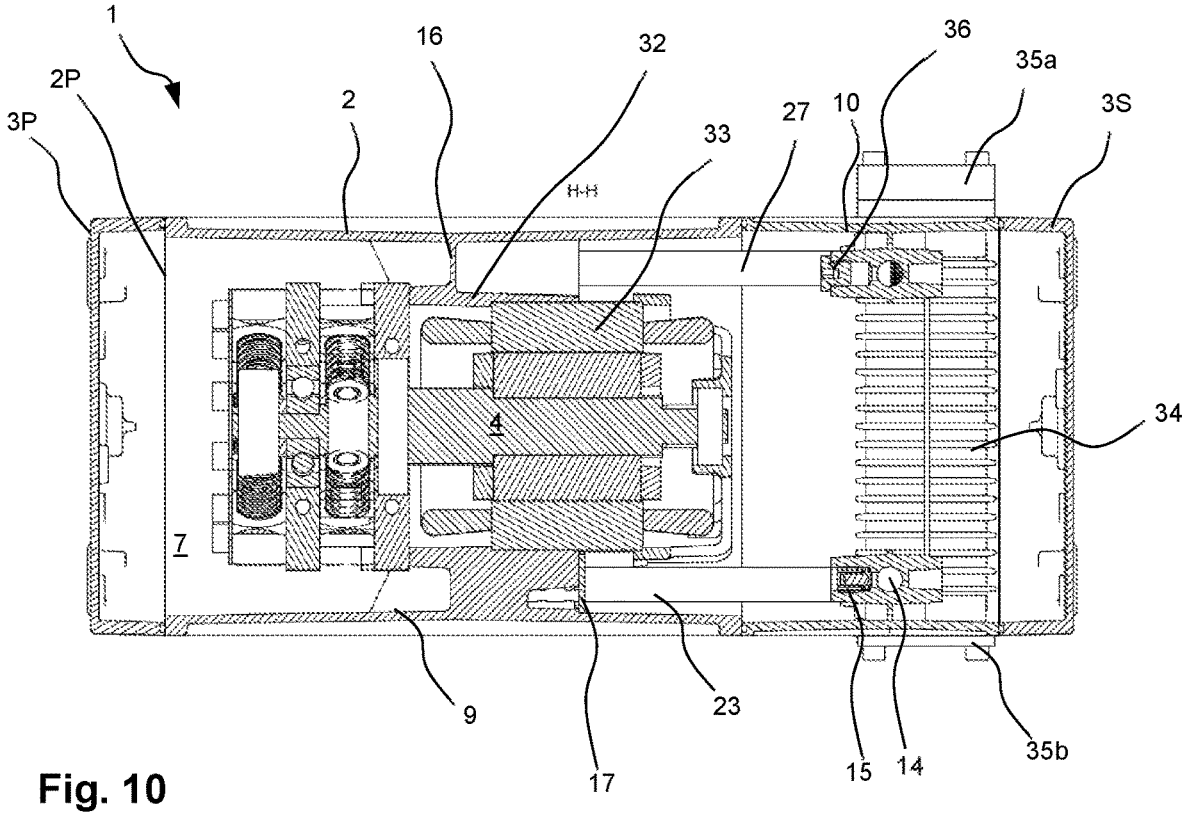
FIG. 10 is a cross section along the line H-H shown in FIG. 8.

To prevent damage to the heat exchanger element 11 by overpressure, the additional housing 10 has a drain channel 14 connected to the hydraulic fluid reservoir 7. The drain channel 14 is provided as a branch channel of the inlet opening 12, sec FIGS. 10 and 11. The drain channel 14 has a safety valve 15 in the form of a preloaded check valve. As shown in FIG. 10, the check valve 15 is screwed into the drain channel 14. If an overpressure builds up in the area of the inlet opening 12, it can be relieved directly into the hydraulic fluid reservoir 7 via the drain channel 14 if the limit pressure of the check valve 15 is exceeded. In order to enable a modular design of the motor pump unit 1, a second drain channel is provided as a branch channel of the outlet opening 13. As shown in FIG. 10, this second drain channel is closed by a screw bolt 36. The resulting modular design of the motor pump unit 1, 100 is described in more detail below.

Figure 11:
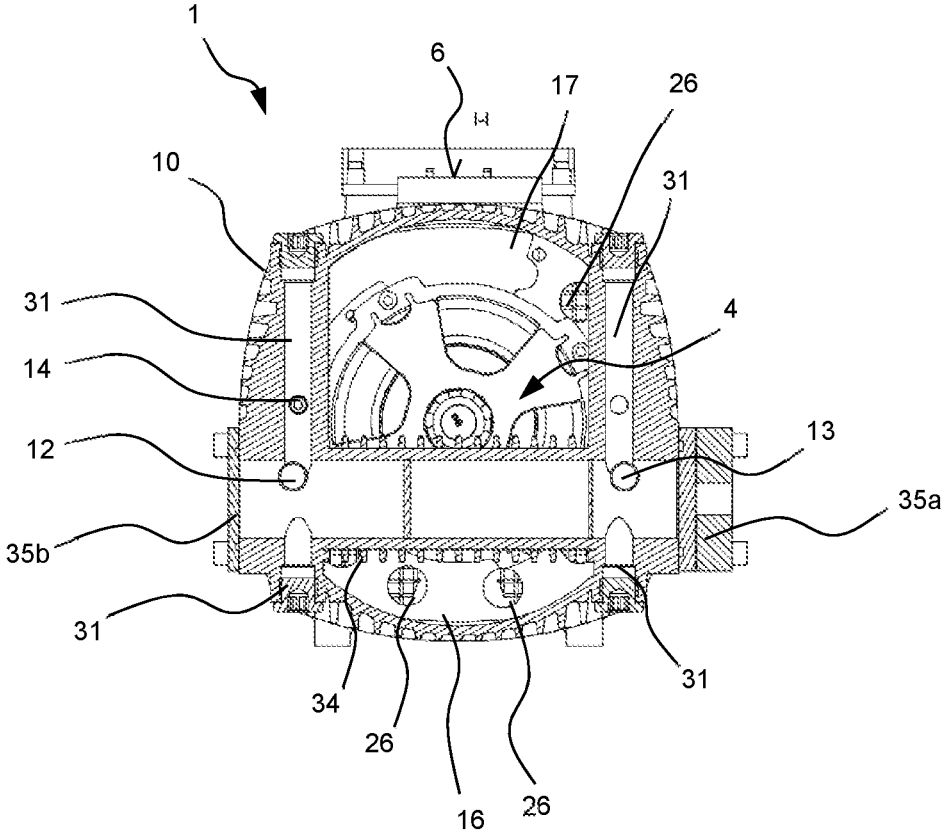
FIG. 11 is a cross section along the line I-I show n in FIG. 1.

As can be seen in FIG. 11, the additional housing 10 also has additional openings 31 which extend outwards through the additional housing 10. In the embodiment shown in FIG. 11, four additional openings 31 are provided which are closed by means of corresponding screw bolts. External hydraulic fluid sources, such as leakage fluid lines, can be connected to these additional openings 31. The externally supplied hydraulic fluid is then fed directly to the heat exchanger element 11 via the respective additional opening 31 and cooled.

Now, with reference to FIGS. 13 to 22, the second embodiment of a motor pump unit 100 according to the disclosure is described below, which further makes the modular design of the motor pump unit 1, 100 even clearer. Hero only the differences to the first embodiment are explained, whereby the same parts are provided with the same reference signs.

As can be seen in FIGS. 13 to 17, the additional housing 10 of the modular motor pump unit 100 is arranged between the pump-side open end 2P and the pump-side housing cover 3P in accordance with the second embodiment. The connection arrangement 19 comprises a first connection tube 127 connecting the inlet opening 12 of the additional housing 10 to the second connection opening 21 of the collection chamber 18. In this embodiment, the first connection opening 20 formed in the cover 17 is closed by a plug 22.

In addition, the motor pump unit 100 has a second connecting tube 127, which connects the outlet opening 13 with an axial through-hole 26 of the transverse wall 16. There is no plug provided to close the through-hole 26 because the hydraulic fluid exits from the second connecting tube 127 either below the fluid level in the hydraulic fluid reservoir 7 or at atmospheric pressure against gravity. There is no need to fear mechanical load and the resulting foaming. Furthermore, a better mixing of the returning hydraulic fluid with the hydraulic fluid in the hydraulic fluid reservoir is achieved. This also makes it possible for the returning hydraulic fluid to degas better.

Figure 17:
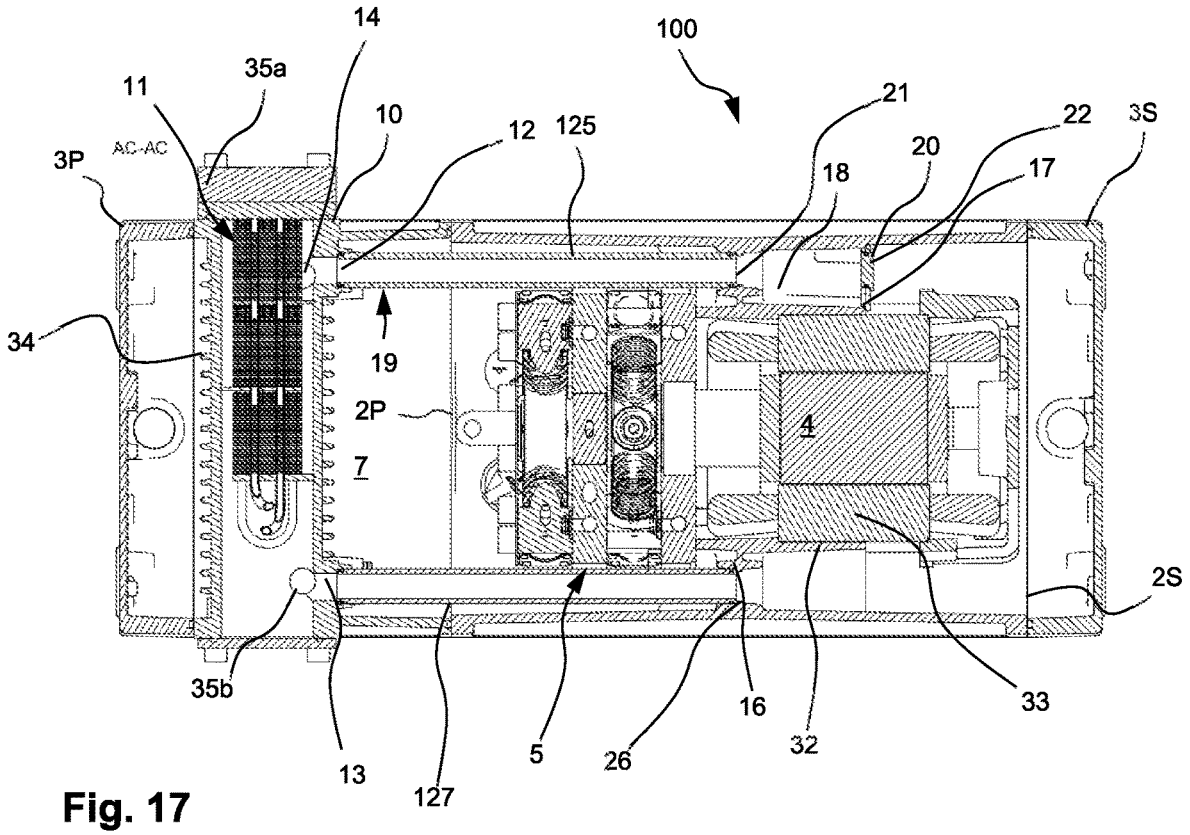
FIG. 17 is a cross section along the line AC-AC shown in FIG. 13.
Figure 18:
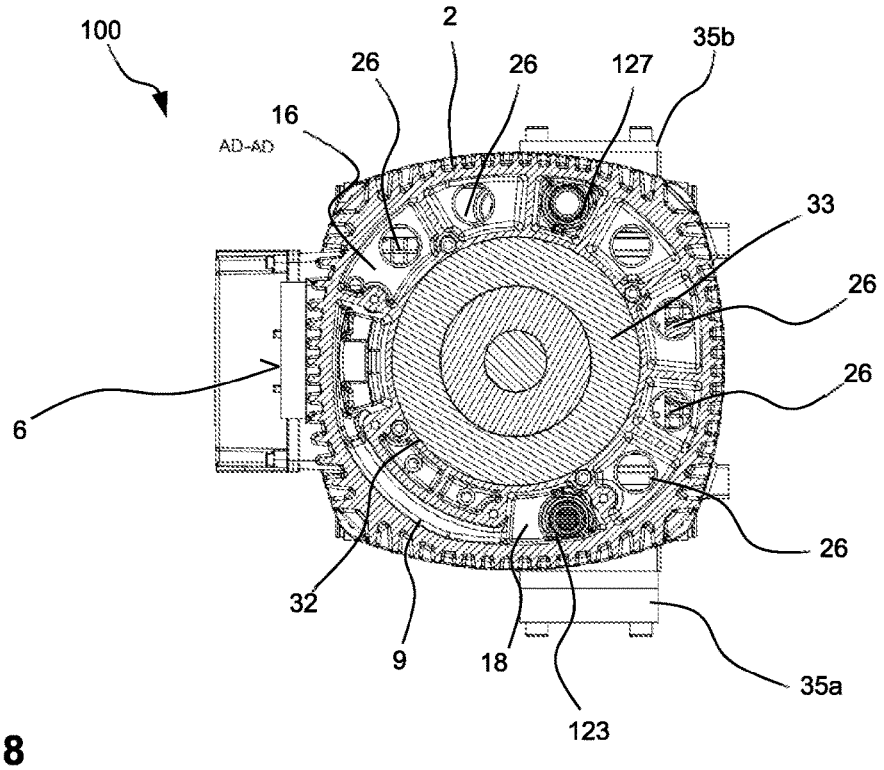
FIG. 18 is a cross section along the line AD-AD shown in FIG. 16.
Figure 19:
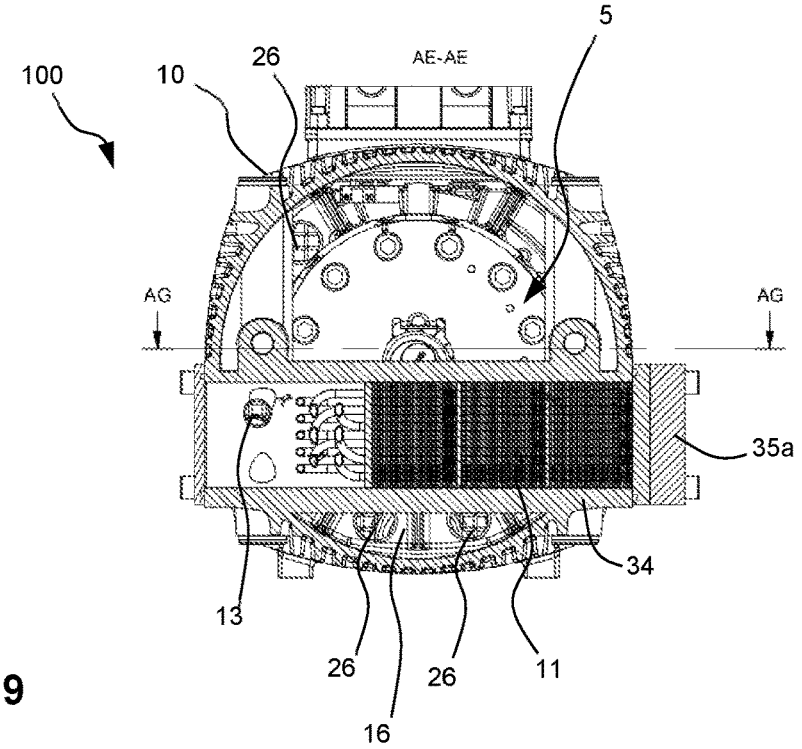
FIG. 19 is a cross section along the line AE-AE shown in FIG. 13.
Figure 20:
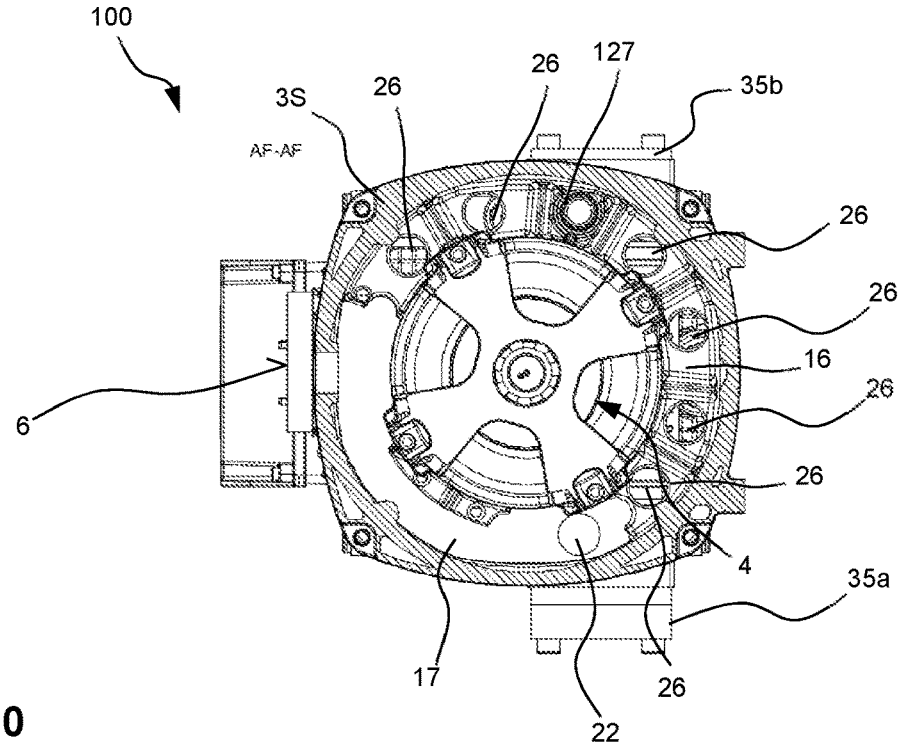
FIG. 20 is a cross section along the line AF-AF shown in FIG. 16.
Figure 21:
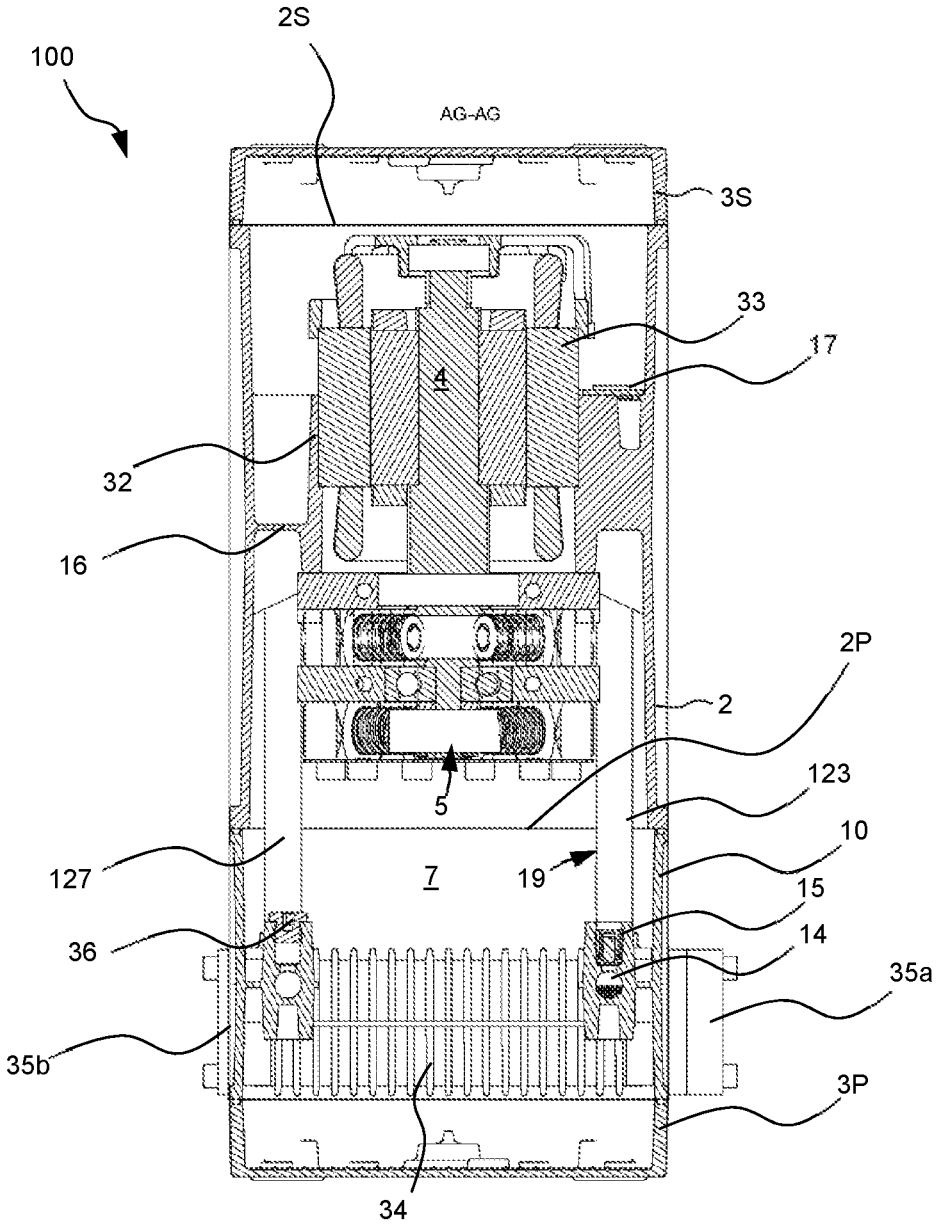
FIG. 21 is a cross section along the line AG-AG shown in FIG. 19.
Figure 22:
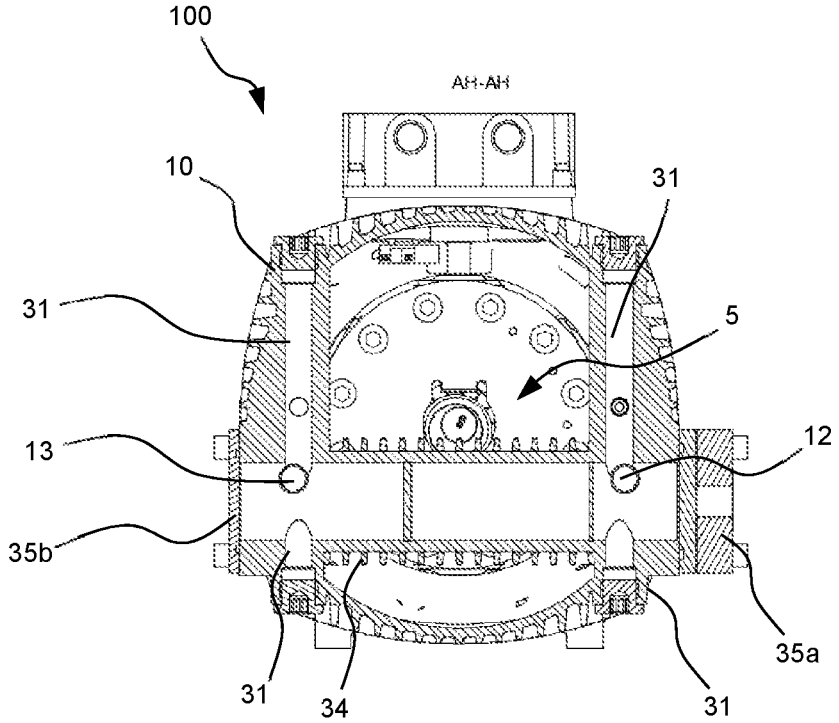
FIG. 22 is a cross section along the line AH-AH shown in FIG. 13.

Further, the additional housing 10 has the same design as the additional housing 10 according to the first embodiment. As shown in FIG. 17, for example, the inlet opening 12 is arranged closer to the heat exchanger element 11. In other words, the inlet opening 12 of the second embodiment is the outlet opening 13 of the first embodiment. For this reason, the motor pump unit 100 is equipped with a cheek valve 15 for the other drain channel 14 in accordance with the second embodiment, and the drain channel now provided at the outlet opening 13 is closed by the screw bolt 36.

Thus, in addition to the arrangement of the additional housing 10, the two aforementioned embodiments differ only in the design of the first and second connecting tubes 23, 27, 123, 127 and the plug 22 for closing the first or second connection opening 20, 21 of the collection chamber 18.

Figure 23:
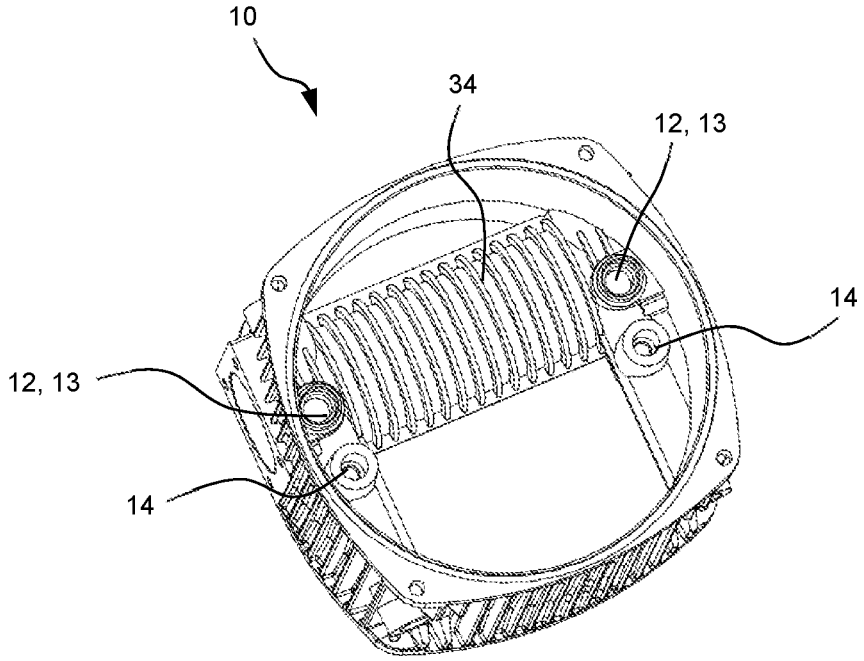
FIG. 23 is a first perspective view of an additional housing with a heat exchange element with liquid cooling.
Figure 24:
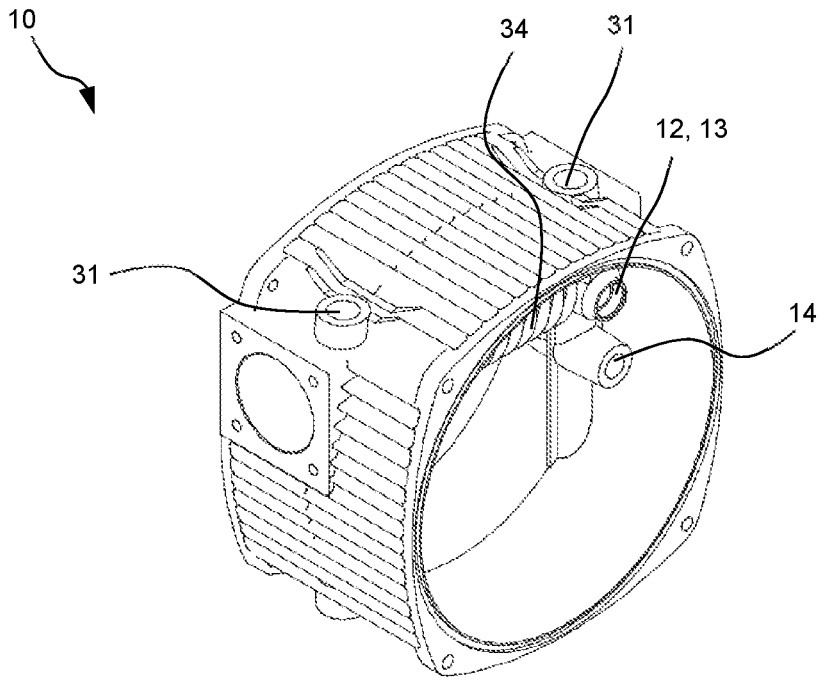
FIG. 24 is a second perspective view of the additional housing shown in FIG. 23.

This can also be seen again in FIGS. 23 and 24, which show the additional housing 10 with the heat exchanger element 11 having a liquid cooling in two perspective views. Especially in FIG. 23 it can be seen that depending on the arrangement of the additional housing 10 at the stator-side open end 2S or at the pump element-side open end 2P the left opening or the right opening can be used as inlet opening 12 or as outlet opening 13. The same applies to the two drain channels 14, into which the screw bolts 36 or the check valve 15 are screwed, depending on the installation of the additional housing 10.

FIG. 23 also shows the optional ribs of the casing 34, which serve for further cooling of the hydraulic fluid.

Figure 25:
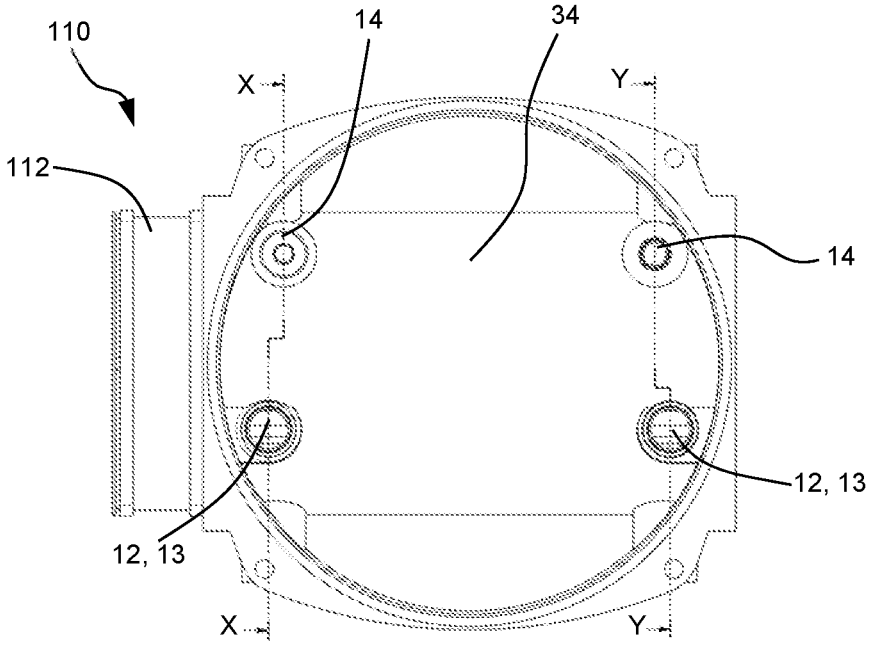
FIG. 25 is a front view of an additional housing with a heat exchanger element with air cooling.
Figure 26:
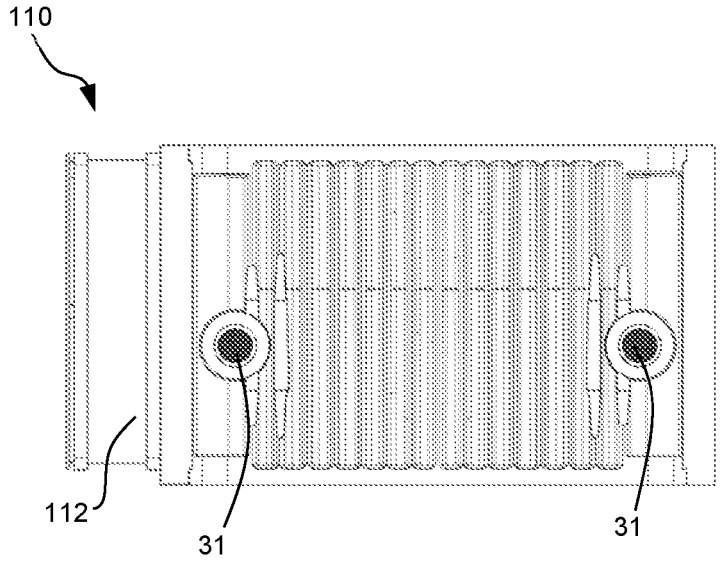
FIG. 26 is a side view of the additional housing shown in FIG. 25.
Figure 27:
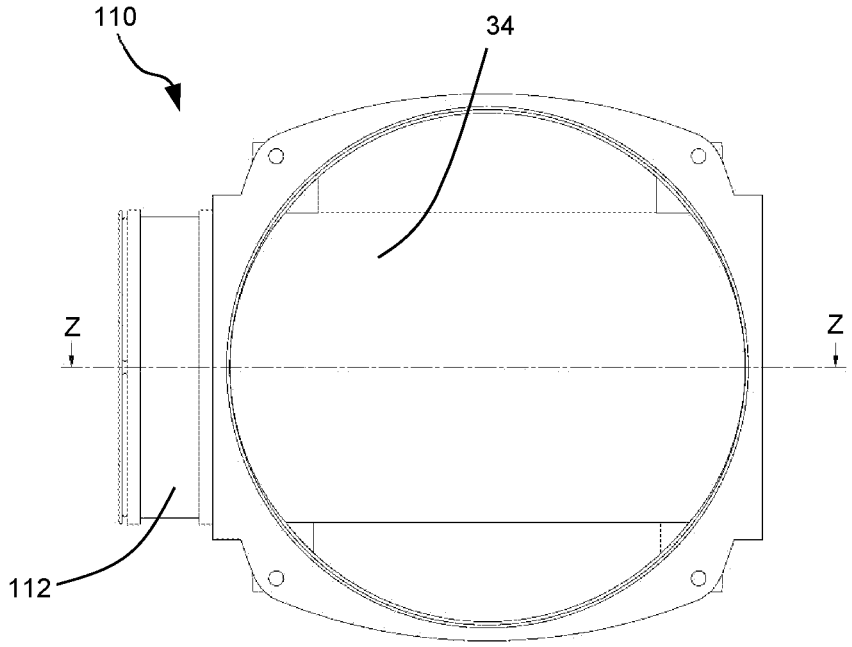
FIG. 27 is a rear view of the additional housing shown in FIG. 25.
Figure 28:
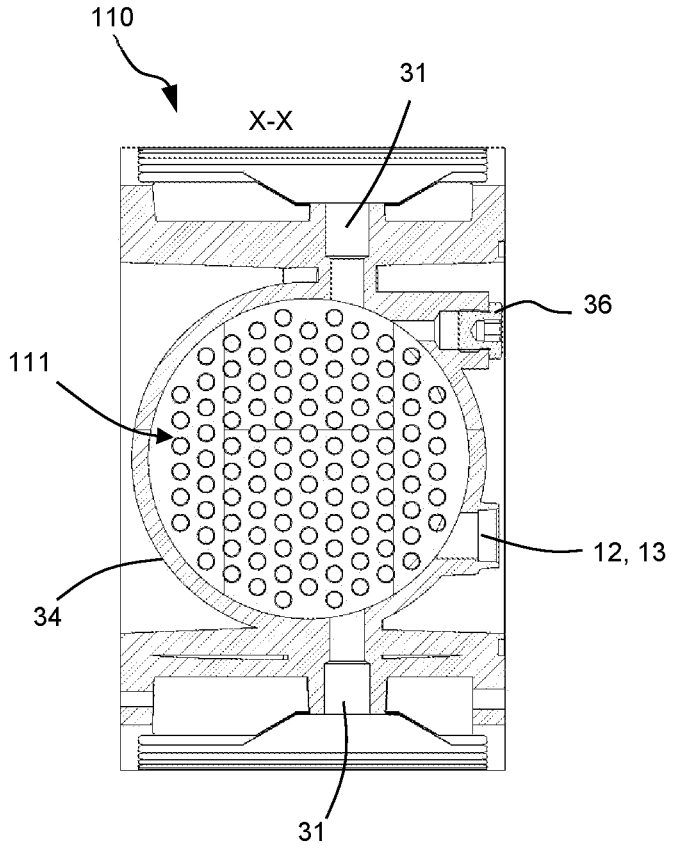
FIG. 28 is a cross section along the line X-X shown in FIG. 25.
Figure 29:
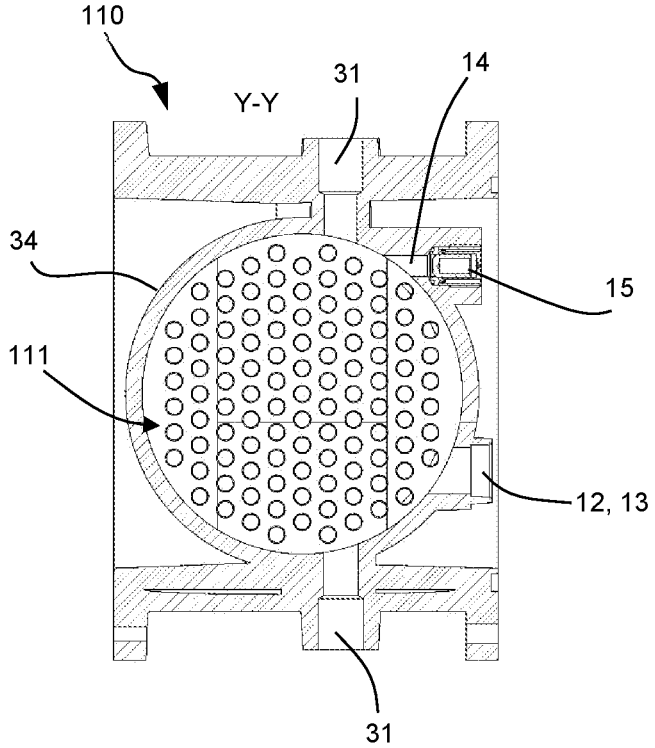
FIG. 29 is a cross section along the line Y-Y shown in FIG. 25.
Figure 30:
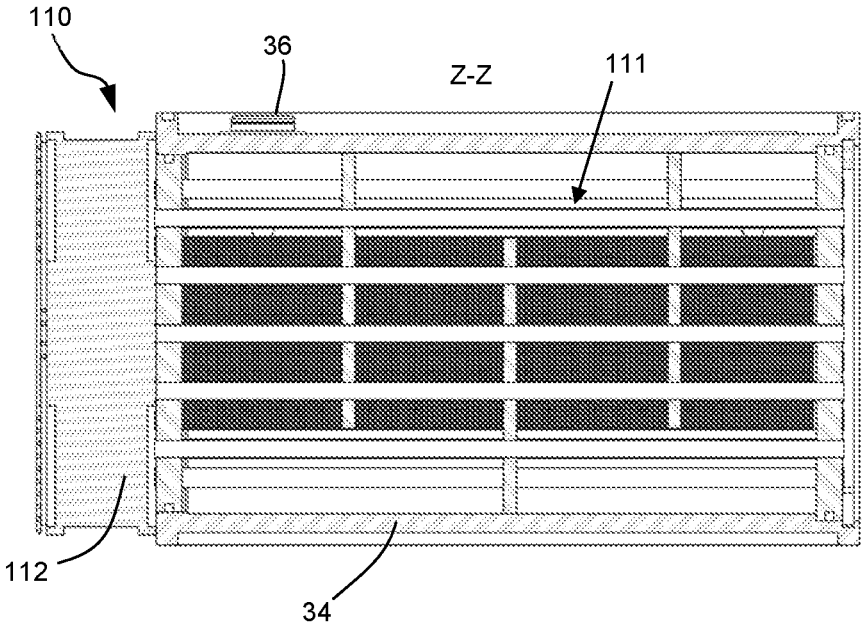
FIG. 30 is a cross section along the cutting line Z-Z shown in FIG. 27.

In FIGS. 25 to 32 an alternative additional housing 110 is shown, which can be used instead of the additional housing 10 shown in FIGS. 24 and 25 with the motor pump unit 1, 100 according to the present disclosure. In the following, only the differences to the additional housing 10 with liquid cooling described above are described.

The additional housing 110 here has a heat exchanger element 111 in the form of air cooling arranged in the casing 34. An external fan 112 is provided for this purpose, which blows the air into the interior of the heat exchanger element 111. As shown in particular in FIGS. 28 to 30, the heat exchanger element 111 has parallel tubes extending from the opening on one side of the additional housing 110 to the opening on the other side of the additional housing 110. The returning hydraulic fluid is led through the inlet opening 12 into the inside of the additional housing 110 and is cooled by the heat exchanger element 111 before leaving the additional housing through the outlet opening 13.

Please note that the connection of the additional housing 110 is identical to the connection of the additional housing 10 with liquid cooling. Thus the additional housing 110 can be attached to the stator-side open end 2S as well as to the pump element-side open end 2P of the outer housing 2. In addition, the additional housing 110 with air cooling can be used for both upright and horizontal use of the motor pump unit 10, 110.

Figure 31:
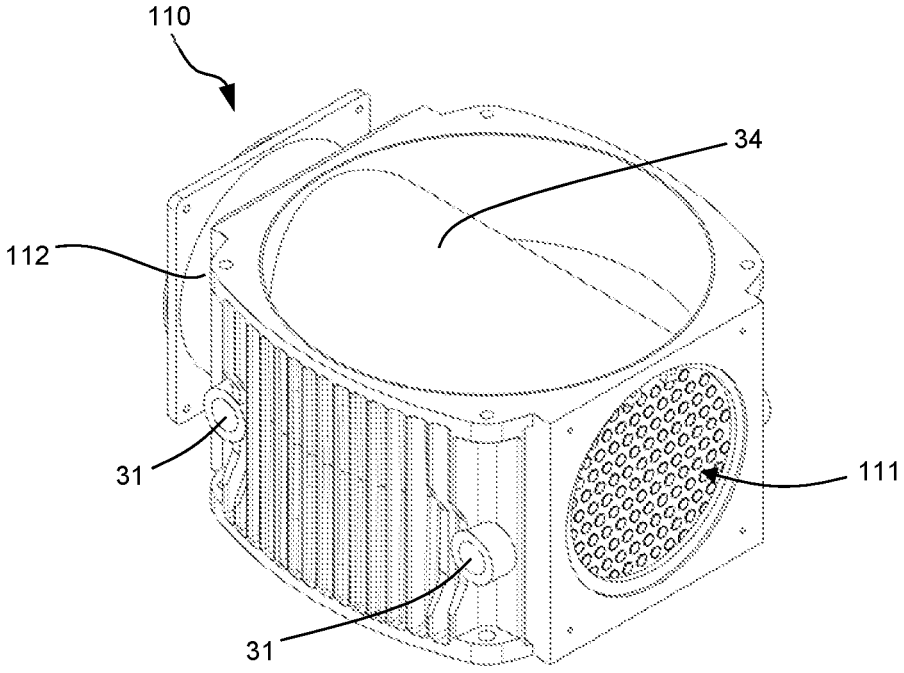
FIG. 31 is a first perspective view of the additional housing shown in FIG. 25.
Figure 32:
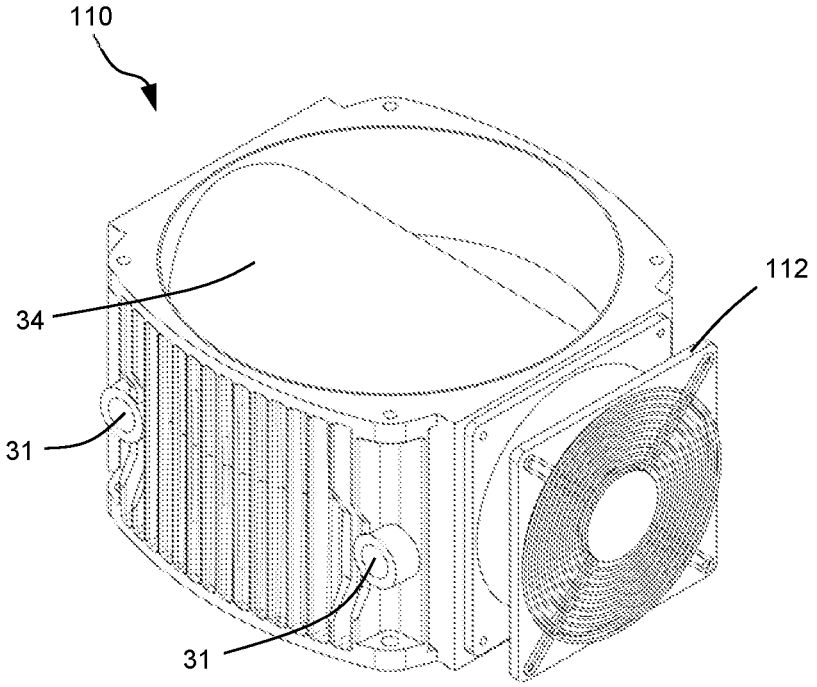
FIG. 32 is a second perspective view of the additional housing shown in FIG. 25.

As shown in FIGS. 31 and 32, the external cooling fan 112 can optionally be arranged at both openings of the additional housing 110. It should be noted that in FIGS. 31 and 32 only the cover of the external cooling fan 112 is shown for better clarity.

In addition, the casing 34 of the additional housing 110 with air cooling does not comprise ribs. Of course it is conceivable, however, that ribs will also be provided on casing 34. Finally, it should also be noted that in FIGS. 28, 29, 31 and 32 the additional openings 31 are shown unsealed. Of course these are either closed with appropriate bolts or connected to external hydraulic fluid sources, e.g., leakage fluid lines of the hydraulic system, during operation of the motor pump unit 1, 100.

LIST OF REFERENCE SIGNS

1, 100 motor pump unit
2 outer housing
2S stator-side open end
2P pump element-side open end
3S stator-side housing cover
3P pump element-side housing cover
4 electric motor
5 pump element
6 connection portion
7 hydraulic fluid reservoir
8 pressure channel
9 return channel
10, 110 additional housing
11, 111 heat exchanger element
12 inlet opening
13 outlet opening
14 drain channel
15 safety valve/preloaded check valve
16 transverse wall
17 cover
18 collection chamber
19 connection arrangement
20 connection opening
21 connection opening
22 plug
23, 123 first connecting tube
24 first end
25 radial opening
26 through-hole
27, 127 second connecting tube
28 second end
29 radial opening
30 plug
31 additional opening
32 stator plug seat
33 stator
34E casing
35*a*, 35*b*, 135 cover plate
36 Screw bolt
112 external fan

What is claimed is:

1. A modular motor pump unit comprising:
an outer housing with two open ends;
two housing covers which can be attached to the open ends, and which form a hydraulic fluid reservoir with the outer housing;
an electric motor which is arranged in the outer housing;
a pump element which is arranged in the outer housing and can be driven by the electric motor;
a connection portion which is arranged on the outside of the outer housing;
at least one pressure channel extending from the pump element to the connection portion; and
a return channel extending from the connection portion into an inside of the outer housing;
an additional housing provided between the outer housing and at least one of the housing covers; and
a heat exchanger element arranged in the additional housing;
wherein the return channel is connected to the additional housing and the additional housing is connected to the hydraulic fluid reservoir.

2. The motor pump unit according to claim 1, wherein the heat exchanger element comprises a liquid cooling.

3. The motor pump unit according to claim 1, wherein the heat exchanger element comprises an air cooling.

4. The motor pump unit according to claim 1, wherein the additional housing has an inlet opening and an outlet opening, the return channel is connected to the inlet opening, and the outlet opening is connected to the hydraulic reservoir.

5. The motor pump unit according to claim 4, wherein the additional housing has a drain channel connected to the hydraulic fluid reservoir with a safety valve.

6. The motor pump unit according to claim 5, wherein the safety valve comprises a pressure-limiting or check valve.

7. The motor pump unit according to claim 5, wherein the drain channel is formed as a branch channel of the inlet opening.

8. The motor pump unit according to claim 1, wherein the outer housing has a transverse wall arranged in an interior of the outer housing and a cover, the transverse wall defining with the cover a collection chamber with a connection arrangement to the additional housing, the return channel emptying into the collection chamber.

9. The motor pump unit according to claim 8, wherein the collection chamber has at least two connection openings, one of the connection openings facing towards one of the open ends of the outer housing, and the other one of the connection openings facing towards the other open end of the outer housing, and wherein one connection opening is connected to the additional housing via the connection arrangement and the other connection opening is closed via a plug.

10. The motor pump unit according to claim 8, wherein the connecting arrangement comprises a first connecting tube, the first connecting tube connecting the collection chamber to the additional housing.

11. The motor pump unit according to claim 10, wherein the first connecting tube has a first end disposed in the collection chamber, the first end having a plurality of radial openings.

12. The motor pump unit according to claim 8, wherein the transverse wall has a plurality of axial through-holes.

13. The motor pump unit according to claim 12, wherein the additional housing is connected via a second connecting tube to one of the axial through-holes.

14. The motor pump unit according to claim 13, wherein the second connecting tube has a second end, wherein the second end has a plurality of radial openings, and wherein either the second end is axially closed or the one through-hole is closed with a plug.

15. The motor pump unit according to claim 1, wherein the additional housing has at least one additional opening, which extends outwards from an inside of the additional housing for connection of an external hydraulic fluid line.

16. The motor pump unit according to claim 1, wherein the additional housing has at least two openings for mounting the heat exchanger element.

* * * * *